United States Patent [19]

Schöttle

[11] 4,255,073

[45] Mar. 10, 1981

[54] AUTOMATIC PLATE FEEDING APPARATUS FOR EMBOSSING MACHINES

[75] Inventor: Helmut A. M. Schöttle, Berlin, Fed. Rep. of Germany

[73] Assignee: Pitney Bowes Deutschland GmbH, Heppenheim, Fed. Rep. of Germany

[21] Appl. No.: 22,013

[22] Filed: Mar. 19, 1979

[30] Foreign Application Priority Data

Mar. 21, 1978 [DE] Fed. Rep. of Germany ... 7808617[U]

[51] Int. Cl.[3] ..... B41J 3/38; B65H 5/16

[52] U.S. Cl. ..... 414/32; 271/4; 271/267; 400/45; 400/134.3; 414/131

[58] Field of Search ..... 414/32, 43, 45, 131; 400/31, 45, 48, 127, 129, 130, 131, 132, 134, 134.1, 134.3; 101/48, 49, 51, 369; 271/267, 268, 269, DIG. 9, 4

[56] References Cited

U.S. PATENT DOCUMENTS

| | | | |
|---|---|---|---|
| 698,966 | 4/1902 | Kitsee | 400/127 |
| 881,955 | 3/1908 | Richards | 400/134 |
| 921,600 | 5/1909 | Duncan | 400/134 |
| 2,528,435 | 10/1950 | Isett | 400/134.3 |
| 2,833,386 | 5/1958 | Hueber | 400/134.3 |
| 3,107,912 | 10/1963 | Fiehl | 414/43 X |
| 4,019,640 | 4/1977 | Marin et al. | 414/45 |

*Primary Examiner*—Leslie J. Paperner

*Attorney, Agent, or Firm*—Peter Vrahotes; William D. Soltow, Jr.; Albert W. Scribner

[57] ABSTRACT

A conveying system for embossing machines that emboss printing plates for address printing machines, identification devices, and the like which includes a carriage with a plate holder. The carriage is arranged in such a manner that the plate holder it can be moved into one of two directions which two directions are perpendicular to each other. One of the directions is in the direction of the type or character spacing within the print line and the second direction, which is perpendicular to the first, is in the direction of the line spacing.

1 Claim, 1 Drawing Figure

AUTOMATIC PLATE FEEDING APPARATUS FOR EMBOSSING MACHINES

BACKGROUND OF THE INVENTION

Embossing machines for embossing printing plates have to be increasingly automated in order to be adapted for individual control, for example, adaptable to be connected to an electronic computer or reading apparatus. To accomplish this, it is necessary to construct the passage of the plates to and away from the embossing machine in a manner that enables automated supply of plates into a plate holder which holds the plate during embossing and automated withdrawal of the plate therefrom.

SUMMARY OF THE INVENTION

According to the invention, a plate carriage transverses a first path and is located adjacent to a second path taken by a plate holder, the two paths being perpendicular to one another. A plate supply hopper is located on the first path. On the opposite side of the first path, a plate stacker is positioned and a plate driving pawl is located on the path on the side of the plate hopper, which pawl can be moved into the hopper.

The plate hopper is fixed to the plate carriage and, therefore, follows its movements. The plate hopper is permanently positioned adjacent the path of the plate holder and is located at the home position of the plate holder. As soon as the plate holder returns into this home position, following the embossing of a plate therein, the plate driving pawl will be actuated automatically or by means of a control signal. The pawl then drives the bottom plate out of the hopper into the plate holder and, simultaneously, the just completely embossed plate is pushed out of the plate holder by the incoming plate. Thus, the next operating cycle for the embossing operation can be started immediately. Because the feeding direction is perpendicular to the path of the plate holder, only short distances are traveled and a simple construction is attained. However, more particularly, based on such an arrangement the movement of only one electrically controlled driving pawl is sufficient to perform the plate change.

It is especially suitable to have the plate hopper, whose top is open, extend upwardly from the first path and the plate stacker whose top is also open, extend downwardly from the path. Therefore, an entire stack of plates prepared for embossing can be easily inserted into the hopper. During the withdrawal of the lowermost plate, the plates within the stack to be embossed will slide down by themselves, so that one plate within the hopper always will be in the plane of the path. The subsequently embossed plates can fall by themselves into the plate stacker which is open at its top and which extends below from the sliding path. Thus, in both the hopper and stacker the force of gravity is used for plate stacking. The energy required for the horizontal plate feeding, therefore, is relatively small. This is an advantage also with respect to automation. Besides, the driving pawl, including its operating device, can be also arranged at the plate carriage or at the housing in such a manner that it can enter through an opening into the plate hopper to insert the next plate into the plate holder when the plate carriage and the plate holder are in their home positions.

Appropriately, the plate holder is formed in such a manner that it is provided with a receiving trough in which the plate will be securely positioned for the embossing operation. On the side facing the plate hopper, the receiving trough is provided with an inlet slot for the bottommost plate of the stack of plates within the plate hopper and on its opposite side it is provided with an outlet slot for plates that have been embossed.

The plates which have been withdrawn from the trough can be allowed to fall directly into the plate stacker, however, it will be particularly suitable in the practice to arrange at the level of the receiving trough an intermediate plate collecting magazine on which each embossed plate will remain until the subsequent embossed plate is withdrawn from the receiving trough this will cause the collected plate to be driven from the intermediate collecting magazine and to fall softly into the plate stacker through a downstream declined slide. The height of fall into the plate stacker can be appropriately reduced by inserting an intermediate bottom which is lifted by a coil spring in the direction to the intermediate plate collecting magazine.

The withdrawal of the embossed plates which are arranged as a stack of plates within the plate stacker will be particularly simple, if the plate stacker is hinged. Appropriately, therefore, the plate stacker may be pivotally mounted on an axis arranged at its bottom on the side which is distal from the magazine and which extends parallel to the second path.

BRIEF DESCRIPTION OF THE DRAWING

The single FIGURE of the drawing is a perspective view of a printing plate conveyor that illustrates the preferred embodiment of the invention.

DETAILED DESCRIPTION OF THE PREFERRED EMBODIMENT

Figure 1:
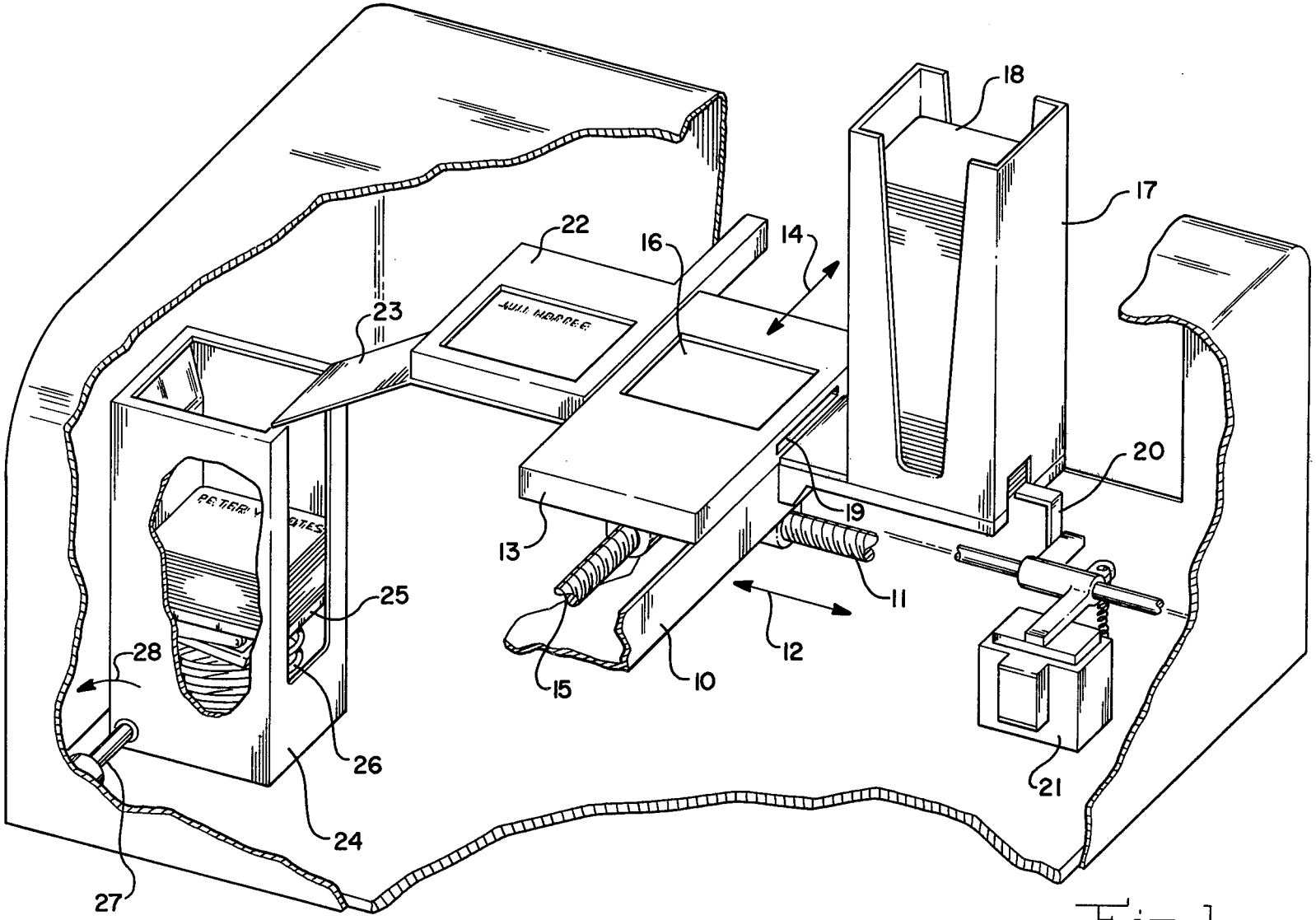

Referring to the drawing, the embossing machine is only partially shown by the coordinate guide for the plates to be embossed. This guide comprises a plate carriage 10 which can be reciprocally moved along a first path in the longitudinal direction indicated by the double arrow 12 by means of a lead screw 11 mounted on a housing 11'. The plate carriage 10 itself carries a plate holder 13 which can be reciprocated through a transverse, second path in the plate carriage 10 as indicated by the double arrow 14 by means of a lead screw 15 mounted at the plate carriage. The plate holder 13 is provided with a receiving trough 16 on its upper surface, the receiving trough having the size of a plate, in which the to be embossed plate will be securely received.

Adjacent to the path 14 of the plate holder 13, a plate hopper 17 is arranged on a side arm 17' fixed to the plate carriage 10. A stack of plates 18 may be inserted into the plate hopper 17. The plate hopper 17 is arranged in a manner so that the respective bottommost plate 18 will be at the level of the receiving trough 16. The bottommost plate 18 can be inserted through an inlet slot 19 of the receiving trough 16. This is performed by means of a stepped driving pawl 20 whose plane of movement coincides with the plane defined on the one hand by bottommost plate 18 of the stack in the hopper 17 and on the other hand by the receiving trough 16. The operation of this driving pawl 20 is only schematically indicated in the drawing and is actuated by an operating magnet 21 which causes the driving pawl to be lifted and to be lowered. The drawing pawl 20 will be in the plane as described above, therefore, when the plate carriage 10 is moved to the right, as seen in the drawing. The end of the driving pawl 20 engages the bottommost plate and moves it into the receiving trough when the plate hopper 17 is moved to the right and passes over the cranked driving pawl 20 as will be apparent from the drawing.

Simultaneously, a plate 18 which had been moved before into the receiving trough 16 is guided through an outlet slot (not shown) which is corresponds to the inlet slot 19 and subsequently may be moved onto an intermediate plate collecting magazine 22 which is connected through a declined slide 23 to the opening in the top of a plate stacker 24 for the embossed plates 18. The upper end of this plate stacker 24 does not exceed the level of the receiving trough 16 and is normally below this. An intermediate bottom 25 is arranged in the plate stacker 24 and is lifted to a more or less higher degree by a coil spring 26 depending upon the weight of the stack of plates 18 within the plate stacker 24 in order to limit the degree of fall of the embossed plates. A swivel shaft 27 extends parallel to the transverse a second path as indicated by the double arrow 14 and is received with the housing 11'. The shaft 27 is arranged at the bottom of the plate stacker 24 below the intermediate bottom 25 on the side of the stacker which is distal from the transverse path 14. By pivoting the plate stacker 24 in the direction as indicated by the arrow 28 an especially simple removal of the embossed plates is provided. Appropriately, the plate stacker 24 is pivotably supported by the housing 11' while the intermediate plate collecting magazine 22 and the slide 23 are connected to the plate carriage 10, as is true for the plate hopper 17. Thereby it will be assumed that pivoting of the plate stacker 24 is possible at each moment in the home position of the coordinate guide of the plate carriage 10 and the plate holder 13.

In operation, the lead screw 11 may be rotated by any convenient means to cause the plate carriage to move to the right as seen in the drawing. This movement will continue until the bottommost plate 18 has been contacted by the uprighted pawl 20 and pushed through the slot 19 into the trough 16. The lead screw 11 will then be operated in the opposite direction until the plate holder 13 is in alignment with the transverse path 14, at which time rotation of the lead screw 11 is terminated. With the plate carriage 10 at rest the lead screw 15 will be rotated to drive the plate holder 13 toward the embossing station (not shown) of the embossing machine. During embossing,.the pawl 20 will be lowered, the lead screw 11 will be rotated for character spacing written each line and the lead screw 15 will be rotated for line spacing. After embossing is completed, the lead screw 15 will be rotated in the proper direction until the trough 16 is in alignment with the longitudinal path, whereafter the cycle will be repeated. As is apparent, when the lowermost plate 18 of the stack is inserted through the slot 19, a plate residing in the trough 16 will be pushed into the collection magazine 22. In turn, any plate 18 residing in the collecting magazine 22 will be pushed onto the slide 23 and will be received within the stacker 24.

What is claimed is:

1. A plate feeding apparatus for feeding plates to be embossed by an embossing machine, comprising: a plate carriage mounted for movement along a first path, means for moving said plate carriage along said first path, a plate holder movably mounted on said plate carriage, means for moving said plate holder along a second path which is substantially perpendicular to said first path, a plate hopper having a slot at the bottom thereof located at a first end of the said first path, said plate holder having a trough therein with an inlet slot adjacent to and in registration with said slot at said bottom of said plate hopper and an outlet slot opposed to said inlet slot, a plate stacker located on the second end of said first path, said plate holder being in communication with said plate stacker through an intermediate magazine having a slide connected thereto that is adjacent to said plate stacker, a driving pawl located at said first end of said path and means for inserting said driving pawl within the bottom of said hopper, and an electromagnetic means for driving said pawl into and out of said first path.

* * * * *

UNITED STATES PATENT AND TRADEMARK OFFICE

CERTIFICATE OF CORRECTION

PATENT NO. : 4,255,073

DATED : March 10, 1981

INVENTOR(S) : Helmut A. M. Schottle

It is certified that error appears in the above—identified patent and that said Letters Patent is hereby corrected as shown below:

Line 5 of the Abstract, delete "it" after -- holder --.

Column 3, line 9, delete "is".

Column 4, line 7, delete ".".

Signed and Sealed this

Tenth Day of November 1981

[SEAL]

*Attest:*

GERALD J. MOSSINGHOFF

*Attesting Officer*

*Commissioner of Patents and Trademarks*